United States Patent [19]

Rembold

[11] Patent Number: 4,889,084

[45] Date of Patent: Dec. 26, 1989

[54] VALVE CONTROL DEVICE WITH MAGNETIC VALVE FOR INTERNAL COMBUSTION ENGINES

[75] Inventor: Helmut Rembold, Stuttgart, Fed. Rep. of Germany

[73] Assignee: Robert Bosch GmbH, Stuttgart, Fed. Rep. of Germany

[21] Appl. No.: 311,803

[22] Filed: Feb. 17, 1989

[30] Foreign Application Priority Data

May 7, 1988 [DE] Fed. Rep. of Germany ..... 3815668

[51] Int. Cl.[4] ..... F01L 1/12; F01L 1/24; F02D 13/02

[52] U.S. Cl. ..... 123/90.12; 123/90.16

[58] Field of Search ..... 123/90.12, 90.13, 90.15, 123/90.16

[56] References Cited

U.S. PATENT DOCUMENTS

| | | | |
|---|---|---|---|
| 4,278,233 | 7/1981 | Zurner et al. | 123/90.12 |
| 4,466,390 | 8/1984 | Babitzka et al. | 123/90.12 |
| 4,671,221 | 6/1987 | Geringer et al. | 123/90.12 |
| 4,674,451 | 6/1987 | Rembold et al. | 123/90.12 |
| 4,696,265 | 9/1987 | Nohira | 123/90.12 |
| 4,765,288 | 8/1988 | Linder et al. | 123/90.16 |

FOREIGN PATENT DOCUMENTS

| | | | |
|---|---|---|---|
| 2926327 | 1/1981 | Fed. Rep. of Germany . | |
| 0047023 | 4/1979 | Japan | 123/90.16 |

*Primary Examiner*—Willis R. Wolfe
*Assistant Examiner*—Weilun Lo
*Attorney, Agent, or Firm*—Edwin E. Greigg

[57] ABSTRACT

A hydraulic valve control device for internal combustion engines having a magnetic valve for controlling the opening and closing time of an inlet or outlet valve in which the fluid pressed out of the stroke transmission chamber by the engine valve springs is stored in a reservoir chamber integrated with the magnetic valve; the reservoir chamber, by displacing the valve member backward, functions as a reservoir piston in the opening direction. A spring acting upon the valve member in the closing direction of the magnetic valve presses the fluid back into the stroke transmission chamber, which now is expanding one again. The magnetic valve communicates with the stroke transmission chamber through the shortest possible fluid conduit.

30 Claims, 3 Drawing Sheets

VALVE CONTROL DEVICE WITH MAGNETIC VALVE FOR INTERNAL COMBUSTION ENGINES

BACKGROUND OF THE INVENTION

The invention is based on a valve control device for controlling the opening and closing times of a motor valve of an internal combustion engine, the motor valve being actuated by a valve control cam of a camshaft via an axially displaceable valve tappet.

In a known valve control device of this type (German Patent Document P 35 32 549.6), an electromagnetic control valve controls the inflow and outflow of pressure medium between the stroke transmission chamber and the return reservoir. The control valve is disposed in the pressure fluid line that connects the stroke transmission chamber with the return reservoir. By opening the magnetic valve, the pressure fluid line is opened up, and the pressure fluid, under the influence of the valve control cam pressing against one side of the stroke transmission chamber and the valve tappet pressing against the other side of the stroke transmission chamber, flows out of the stroke transmission chamber into the return reservoir, which decreases the axial length of the stroke transmission chamber. Despite a further stroke motion of the valve control cam in the direction of valve opening, the valve tappet can thus move toward the valve control cam, under the influence of the valve closing spring, and thereby close the valve. Depending on how the instant of closing is set, the quantity of fuel mixture aspirated into the cylinder can be adapted to the varying requirement for various operating states. As soon as the pressure of the valve control cam lets up, the pressure fluid flows out of the return reservoir back into the stroke transmission chamber, via a bypass line that bypasses the magnetic valve, and the outset situation for the next valve opening phase is thus re-established. It is important in this connection that this should take place with as little delay as possible, even at high engine and hence camshaft rpm, because the valve opening times determine the fuel mixture metering, and this quantity should be adapted accurately to requirements at a given time, to attain the most complete possible combustion, with low toxic emissions. The delay is less, the shorter the route between the reservoir and the stroke transmission chamber. In the aforementioned known valve control device, the return reservoir is located at a relatively great distance from the stroke transmission chamber, adjoining the magnet control valve at the end of the pressure fluid line in the cylinder head. Aside from the relatively long routes that the pressure fluid must take between the stroke transmission chamber and the reservoir, the space required by the return reservoir and the production cost for the engine cylinder head are also disadvantages.

OBJECT AND SUMMARY OF THE INVENTION

The magnetic control valve according to the invention as defined by the body of the main claim has the advantage over the prior art that the distance to be traveled by the control fluid between the stroke transmission chamber and the return reservoir is markedly shorter, so that the resumption of the outset state takes place faster. At the same time, the use of the magnetic control valve according to the invention reduces the production cost of the cylinder head and decreases the space required by the complete valve control device, because the return reservoir is integrated with the magnetic valve and is no longer present in the form of a separate part.

One advantageous embodiment of the invention is attained in that a throttle bore in the valve member effects a pressure equalization between the reservoir chamber and the magnet armature chamber, which leads to the same pressure on both sides of the valve member and hence to a lessening of the force counteracting the closing movement. The pressure equalization via the throttle bore between the reservoir chamber and the magnet armature room lessens the force required to close the magnetic valve, which in turn has a favorable effect on the design of the electromagnet.

Another advantageous embodiment of the invention is that the valve member is embodied as a hollow cylinder, with a reservoir piston that is radially tightly guided but axially displaceable in the valve member; this reservoir piston is acted upon by the fluid flowing out of the stroke transmission chamber into the reservoir chamber, resulting in a particularly simple and likewise favorable structural design of the control valve. The magnet armature and the valve member require much less play in motion; this makes the magnet armature easier to guide. Thus, external dimensions of the control valve can be reduced.

The invention will be better understood and further objects and advantages thereof will become more apparent from the ensuing detailed description of a preferred embodiment taken in conjunction with the drawings.

DESCRIPTION OF THE PREFERRED EMBODIMENT

Figure 1:
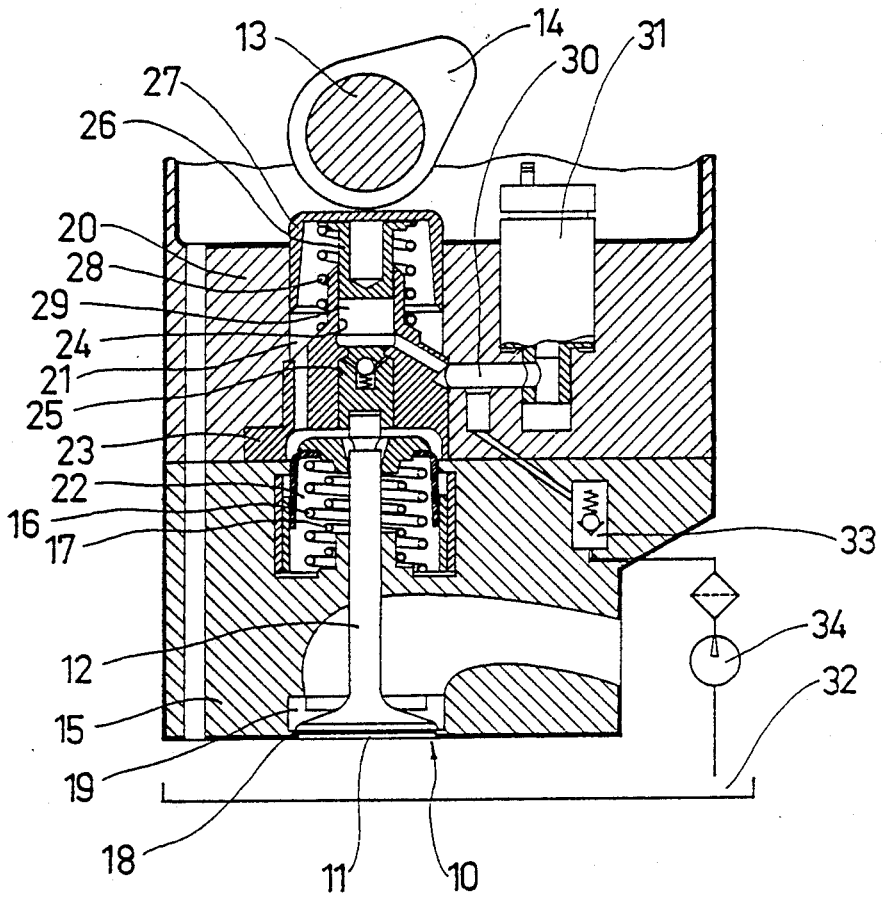
FIG. 1 is a longitudinal section through the valve control device having a magnetic control valve according to the invention, which is shown in a nonsectional, simplified view.

The valve control device shown in FIG. 1 for an inlet or outlet valve 10 of an internal combustion engine is disposed between a valve tappet 12, carrying a valve member 11, and a valve control cam 14 that rotates with a camshaft 13. The valve tappet 12 is guided axially displaceably in a valve housing 15 and with the valve member 11 , under the influence of two valve closing springs 16, 17, rests on a valve seat 18 in the valve housing 15; the valve seat 18 surrounds a valve inlet or outlet opening 19.

The valve control device has a second housing 20 mounted on the valve housing 15; in the second housing, a housing chamber 21 is provided such that it is substantially in alignment with a spring chamber 22, in the valve housing 15, that surrounds the coaxial valve closing springs 16, 17. A housing block 23, which has a continuous central, axial housing bore 24, is inserted into the housing chamber 21 from below. A valve piston 25 connected to the valve tappet 12 and a piston segment 26, disposed above the valve piston 25, of a cam piston 27 are axially displaceable in the housing bore 24. The cam piston 27 is pressed against the valve control cam 14 by a restoring spring 28 that is supported on the housing block 23. The piston segment 26 is either firmly connected to the cup-shaped cam piston 27, or as shown here is held form-fittingly on the cam piston 27 via the same restoring spring 28.

The axial housing bore 24, the valve piston 25 and the piston segment 26 define a stroke transmission chamber 29 that is filled with a pressure fluid, in this case oil; its effective axial length between the cam piston 27 and the valve piston 25 can be varied by relative motion of the pistons to one another. The stroke transmission chamber (29) communicates via a line 30 with a magnetic control valve 31 on the one hand and with a supply container 32 on the other; a one-way check valve 33 and a feed pump 34 are incorporated between the line 30 and the supply container 32. Via the line 30, the volume of oil present in the stroke transmission chamber 29 can be displaced into a spring reservoir of the magnetic control valve 31 and back again. Leakage losses in the oil volume are made up from the supply container 32 via the feed pump 34 and the check valve 33. The magnetic valve 31 controls the oil volume and hence the axial length of the stroke transmission chamber 29.

Figure 2:
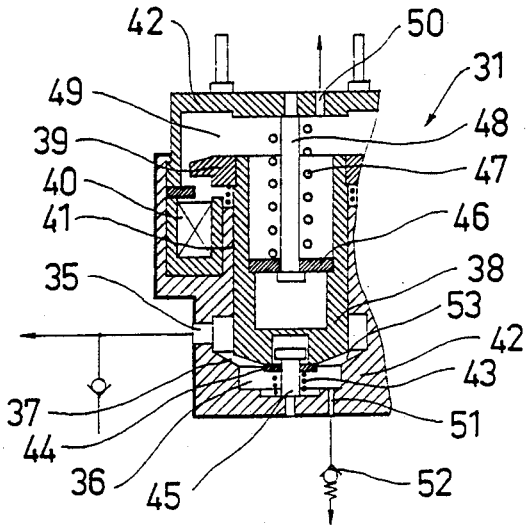
FIG. 2 is a longitudinal section through the magnetic valve.

The magnetic control valve 31 shown in longitudinal section in FIG. 2 is connected at its valve inlet 35 to the portion of the line 30 communicating with the stroke transmission chamber 29. The valve inlet 35 communicates with a reservoir chamber 36 via a flow opening 37; passage through the opening 37 is controlled by a valve member 38. The valve member 38 is connected to an armature 39 of an electromagnet 40 and is displaceably guided in an axial bore 41 in the control valve housing 42. The storage chamber 36 for the pressure fluid is defined by the valve element 38 and the valve housing 42. On the side of the flow opening 37, between the valve member 38 and the valve housing 42, there is a first spring 43, which is supported at one end on the valve housing 42 and on the other on a stop disk 44, which is held in place via a stop bolt 45 connected to the housing. When the electromagnet 40 is not excited, the valve member 38 is pressed by the first spring 43 against a second stop disk 46 shown seated on a shoulder within a chamber within valve member 38, which in turn is held in place by a second spring 47 to a stop bolt 48 connected to the housing. The valve member 38 is kept in the valve opening position by the first spring 43 whenever the electromagnet 40 is not excited. The magnet armature chamber 49 communicates via a bore 50 in the control valve housing 42 with the crankcase, not shown. The reservoir chamber 36 communicates with the crankcase as well, via a throttle bore 51 and a one-way pressure maintenance valve 52 that opens toward the crankcase.

The function of the above-described valve control device having the magnetic control valve with an integrated reservoir is as follows:

After excitation of the electromagnet 40, the valve member 38 is first pressed onto the valve seat 53, causing the closure of the flow opening 37. This blocks off the stroke transmission chamber 29, and the stroke motion of the cam piston 27 is transmitted to its full extent to the valve piston 25 and hence to the inlet valve 10, which thus travel the same stroke distance as the cam piston 27. Fuel mixture flows into the cylinder (not shown) of the engine. The closing process of the inlet valve 10 is initiated, in accordance with the desired filling quantity of fuel mixture, by shutting off the magnet. Upon shutoff of the excitation current, the magnetic control valve 31 opens, since the valve member 38 is pressed by the restoring spring 43 against the stop disk 44, into its opening position. Under the influence of the two valve closing springs 16, 17 of the inlet valve 10, the valve piston 25 can now move upward into the reservoir chamber 36, expelling oil out of the stroke transmission chamber 29 via the flow opening 37 in the magnetic control valve 31. The valve member 11 of the engine valve reaches the valve seat, and the inlet valve 10 is closed. The quantity of oil positively displaced out of the stroke transmission chamber 29 flows into the reservoir chamber 36 and moves the valve member 38 upward, overriding the spring 47. This simultaneously enlarges the flow cross section of the flow opening 37, which promotes a rapid drainage of the oil out of the stroke transmission chamber 29 and hence promotes a fast closure of the inlet valve 10, The force of the springs 16 and 17 is greater than that of the spring 47, which in turn is greater than that of the spring 43.

Once the cam piston 27, after suitable rotation of the valve control cam 14, begins to move upward again toward its position shown in FIG. 1, the oil flows under the influence of the spring 47 out of the reservoir chamber 36 via the opened flow opening 37 back into the stroke transmission chamber 29, which is now expanding again. For the pressure equalization in the magnet armature chamber 49 during the movement of the valve member 38, communication of the magnet armature chamber 49 with the crankcase via a bore 50 in the magnetic valve housing 42 is advantageously provided. The reservoir chamber 36 communicates with the crankcase as well, via a throttle bore 51 and a pressure maintenance valve 52, in order to assure that the static pressure in the reservoir chamber 36 will not become excessively high, and to assure reliable closure of the magnetic valve. In dynamic operation, the throttle 51 is primarily operative, so that the reservoir losses remain low.

Figure 3:
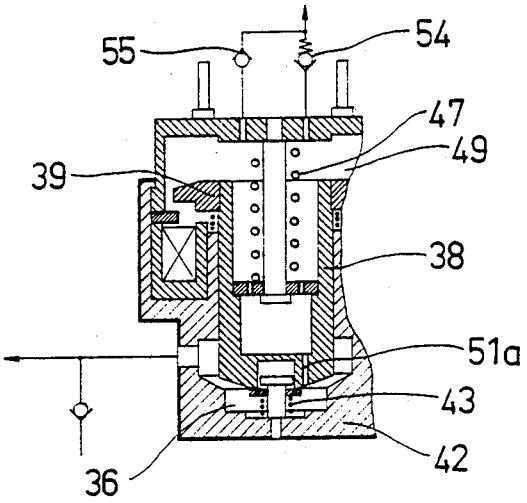
FIG. 3 is a similar view of a variant magnetic control valve.

In the variant magnetic control valve 31 shown in FIG. 3, instead of the throttle bore 51 a throttle bore 51*a* is provided, which connects the reservoir chamber 36 with the magnet armature chamber 49 via at least one throttle in stop disk 46 and thereby effects the equalization of the static pressure on both sides of the valve member 38. For fast ventilation and bleeding, the magnet armature chamber 49 communicates with the crankcase both via a pressure maintenance valve 54 that opens toward the crankcase and via a check valve 55 opening toward the magnet armature chamber 49. The pressure equalization between the reservoir chamber 36 and the magnet armature chamber 49 lessens the contrary force that is operative upon closure of the magnetic control valve.

Figure 4:
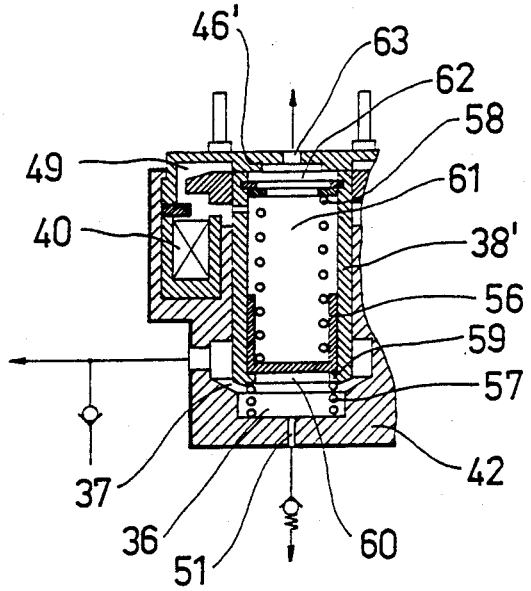
FIG. 4 is a similar view of a further variant magnetic valve.

FIG. 4 shows a further variant of the magnetic control valve 31, in which instead of the valve member 38 itself serving as the reservoir piston, a separate reservoir piston 56 is fitted form-fittingly and axially displaceably into the interior of the valve member 38'. The valve member 38' is kept in the opening position, when the magnet coil 40 is not excited, by a restoring spring 57 which engages the valve member 38' and presses them against the control valve housing 42. The reservoir piston 56 is pressed against a stop 59 on the lower end of the valve member 38' by a second spring 58, which is supported on the upper inside of the valve member 38'. On its face end toward the flow opening 37, the valve member 38' has a recess 60, through which the pressure of the oil flowing in from the stroke transmission chamber 29 can act upon the reservoir piston 56. The reservoir piston 56 is deflected upward, overriding the spring 58. After suitable rotation of the valve control cam 14, the spring 58 presses the reservoir piston 56 back down again, thus pressing the oil through the flow opening 37 and the line 30 back into the stroke transmission chamber 29. In this variant as well, the above-described measures for equalizing the pressure between the reservoir chamber 36 and the magnet armature chamber 49 or spring chamber 61 can be taken. The valve member 38′ and the control valve housing 42 advantageously have recesses 62 and 63 on their respective upper ends, which establish communication between the spring chamber 61 and the crankcase. As a result, the force counteracting the reservoir piston movement is reduced and the control process is speeded up. A further variant is obtained if the spring 58 is supported on the control valve housing 42 instead of on the valve member 38′. To that end, the spring forces need merely be dimensioned such that when the electromagnet is not excited, the valve member 38′ is kept in the opening position and the reservoir piston 56 is simultaneously pressed against the stop 59.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. A valve control device for controlling the opening and closing time of a cylinder valve (10) of an internal combustion engine, the cylinder valve being actuated by a valve control cam (14) of a camshaft (13) via an axially displaceable valve tappet (12), a stroke transmission chamber (29) disposed between the valve control cam and the valve tappet and a conduit for varying the axial length of said stroke transmission chamber between the valve control cam and the valve tappet said conduit is controllable by a magnetic valve (31) for draining out and supplying fluid, said conduit discharging at one end in a fluid reservoir (36), said fluid reservoir (36) is integrated with the magnetic valve (31) and by deflection of a valve member (38) of said magnetic valve (31) develops into a reservoir piston in the opening direction past a position that opens up a flow opening (37) to said fluid reservoir (36).

2. A valve control device as defined by claim 1, in which said magnetic valve (31) is connected with a fluid line (30) directly to the stroke transmission chamber (29).

3. A valve control device as defined by claim 1, which includes a first spring (43) acting in an open direction and engages said valve member (38) connected to an armature (39) of an electromagnet (40), said first spring presses the valve member (38) against a stop (46), in a position that opens up the flow opening (37).

4. A valve control device as defined by claim 2, which includes a first spring (43) acting in an open direction and engages said valve member (38) connected to an armature (39) of an electromagnet (40), said first spring presses the valve member (38) against a stop (46), in a position that opens up the flow opening (37).

5. A valve control device as defined by claim 3, in which said stop (46) is resiliently embodied and is loaded by a second spring (47), acting in a closing direction of said valve member (38) and supported on the control valve housing (42), the force of which said second spring is greater than that of the first spring, so that said valve member (38), upon overcoming the second spring (47), as the reservoir piston, deflects in an opening direction and thereby forms the reservoir chamber (36).

6. A valve control device as defined by claim 4, in which said stop (46) is resiliently embodied and is loaded by a second spring (47), acting in a closing direction of said valve member (38) and supported on the control valve housing (42), the force of which said second spring is greater than that of the first spring, so that said valve member (38), upon overcoming the second spring (47), as the reservoir piston, deflects in an opening direction and thereby forms the reservoir chamber (36).

7. A valve control device as defined by claim 1, in which for pressure equalization upon the movements of the valve member (38), a magnet armature chamber (49) communicates, via a bore (50) in a wall of a control valve housing (42), with a crankcase, and that the reservoir chamber case, and that the reservoir chamber (36) likewise communicates with the crankcase, via a throttle bore (51) in the control valve housing (42) and a pressure maintenance valve (52) opening toward the crankcase, in order to prevent the pressure in the reservoir chamber (36) from exceeding a maximum value.

8. A valve control device as defined by claim 2, in which for pressure equalization upon the movements of the valve member (38), a magnet armature chamber (49) communicates, via a bore (50) in a wall of a control valve housing (42), with a crankcase, and that the reservoir chamber case, and that the reservoir chamber (36) likewise communicates with the crankcase, via a throttle bore (51) in the control valve housing (42) and a pressure maintenance valve (52) opening toward the crankcase, in order to prevent the pressure in the reservoir chamber (36) from exceeding a maximum value.

9. A valve control device as defined by claim 3, in which for pressure equalization upon the movements of the valve member (38), a magnet armature chamber (49) communicates, via a bore (50) in a wall of a control valve housing (42), with a crankcase, and that the reservoir chamber case, and that the reservoir chamber (36) likewise communicates with the crankcase, via a throttle bore (51) in the control valve housing (42) and a pressure maintenance valve (52) opening toward the crankcase, in order to prevent the pressure in the reservoir chamber (36) from exceeding a maximum value.

10. A valve control device as defined by claim 4, in which for pressure equalization upon the movements of the valve member (38), a magnet armature chamber (49) communicates, via a bore (50) in a wall of a control valve housing (42), with a crankcase, and that the reservoir chamber case, and that the reservoir chamber (36) likewise communicates with the crankcase, via a throttle bore (51) in the control valve housing (42) and a pressure maintenance valve (52) opening toward the crankcase, in order to prevent the pressure in the reservoir chamber (36) from exceeding a maximum value.

11. A valve control device as defined by claim 7, in which a pressure equalization between the reservoir chamber (36) and the magnet armature chamber (49) is attained via a throttle bore (51*a*) in the valve member (38), and that the magnet armature chamber (49) communicates with the crankcase via suitable lines, via a pressure maintenance valve (54) opening toward the crankcase and via a check valve (55) opening toward the magnet armature chamber (49).

12. A valve control device as defined by claim 8, in which a pressure equalization between the reservoir chamber (36) and the magnet armature chamber (49) is attained via a throttle bore (51*a*) in the valve member (38), and that the magnet armature chamber (49) communicates with the crankcase via suitable lines, via a pressure maintenance valve (54) opening toward the crankcase and via a check valve (55) opening toward the magnet armature chamber (49).

13. A valve control device as defined by claim 9, in which a pressure equalization between the reservoir chamber (36) and the magnet armature chamber (49) is attained via a throttle bore (51*a*) in the valve member (38), and that the magnet armature chamber (49) communicates with the crankcase via suitable lines, via a pressure maintenance valve (54) opening toward the crankcase and via a check valve (55) opening toward the magnet armature chamber (49).

14. A valve control device as defined by claim 10, in which a pressure equalization between the reservoir chamber (36) and the magnet armature chamber (49) is attained via a throttle bore (51*a*) in the valve member (38), and that the magnet armature chamber (49) communicates with the crankcase via suitable lines, via a pressure maintenance valve (54) opening toward the crankcase and via a check valve (55) opening toward the magnet armature chamber (49).

15. A valve control device as defined by claim 1, in which said valve member (38') is embodied as a hollow cylinder, having a reservoir piston (56) that is radially tightly guided and axially displaceable in the valve member (38'), which piston is acted upon by the fluid flowing out of the stroke transmission chamber (29) into the reservoir chamber (36).

16. A valve control device as defined by claim 2, in which said valve member (38') is embodied as a hollow cylinder, having a reservoir piston (56) that is radially tightly guided and axially displaceable in the valve member (38'), which piston is acted upon by the fluid flowing out of the stroke transmission chamber (29) into the reservoir chamber (36).

17. A valve control device as defined by claim 3, in which said valve member (38') is embodied as a hollow cylinder, having a reservoir piston (56) that is radially tightly guided and axially displaceable in the valve member (38'), which piston is acted upon by the fluid flowing out of the stroke transmission chamber (29) into the reservoir chamber (36).

18. A valve control device as defined by claim 15, in which an upper portion of the control valve housing (42) forms a stop.

19. A valve control device as defined by claim 15, in which said reservoir piston (56) is loaded by a spring (58) that is supported in the valve member (38') and presses the reservoir piston (56) against a stop (59) disposed on the valve member (38').

20. A valve control device as defined by claim 18, in which said reservoir piston (56) is loaded by a spring (58) that is supported in the valve member (38') and presses the reservoir piston (56) against a stop (59) disposed on the valve member (38').

21. A valve control device as defined by claim 15, in which said valve member (38') has a recess (62) on the side of the magnet armature (39) through which the piston spring chamber (61) communicates with the crankcase via a recess (63) in the magnetic valve housing (42).

22. A valve control device as defined by claim 18, in which said valve member (38') has a recess (62) on the side of the magnet armature (39) through which the piston spring chamber (61) communicates with the crankcase via a recess (63) in the magnetic valve housing (42).

23. A valve control device as defined by claim 15, in which said reservoir chamber (36) communicates with the crankcase via a throttle bore 51 and a pressure maintenance valve (52) opening toward the crankcase.

24. A valve control device as defined by claim 18, in which said reservoir chamber (36) communicates with the crankcase via a throttle bore (51) and a pressure maintenance valve (52) opening toward the crankcase.

25. A valve control device as defined by claim 19, in which said reservoir chamber (36) communicates with the crankcase via a throttle bore (51) and a pressure maintenance valve (52) opening toward the crankcase.

26. A valve control device as defined by claim 21, in which said reservoir chamber (36) communicates with the crankcase via a throttle bore (51) and a pressure maintenance valve (52) opening toward the crankcase.

27. A valve control device as defined by claim 15, which includes a throttle bore in the reservoir piston (56), said throttle bore effects a pressure equalization between the reservoir chamber (36) and the piston spring chamber (61), and that the piston spring chamber (61) communicates with the crankcase via suitable lines, via a pressure maintenance valve opening toward the crankcase and via a check valve opening toward the piston spring chamber (61).

28. A valve control device as defined by claim 18, which includes a throttle bore in the reservoir piston (56), said throttle bore effects a pressure equalization between the reservoir chamber (36) and the piston spring chamber (61), and that the piston spring chamber (61) communicates with the crankcase via suitable lines, via a pressure maintenance valve opening toward the crankcase and via a check valve opening toward the piston spring chamber (61).

29. A valve control device as defined by claim 19, which includes a throttle bore in the reservoir piston (56), said throttle bore effects a pressure equalization between the reservoir chamber (36) and the piston spring chamber (61), and that the piston spring chamber (61) communicates with the crankcase via suitable lines, via a pressure maintenance valve opening toward the crankcase and via a check valve opening toward the piston spring chamber (61).

30. A valve control device as defined by claim 21, which includes a throttle bore in the reservoir piston (56), said throttle bore effects a pressure equalization between the reservoir chamber (36) and the piston spring chamber (61), and that the piston spring chamber (61) communicates with the crankcase via suitable lines, via a pressure maintenance valve opening toward the crankcase and via a check valve opening toward the piston spring chamber (61).

* * * * *